US006389703B1

(12) United States Patent
Ferenczi

(10) Patent No.: US 6,389,703 B1
(45) Date of Patent: May 21, 2002

(54) TOOL FOR VEHICULAR BODY PANEL REPAIR

(76) Inventor: Joseph C. Ferenczi, 139 Oceanview Pl., Staten Island, NY (US) 10308

( * ) Notice: Subject to any disclaimer, the term of this patent is extended or adjusted under 35 U.S.C. 154(b) by 0 days.

(21) Appl. No.: 09/635,085

(22) Filed: Aug. 8, 2000

(51) Int. Cl.[7] ..... G01B 5/20
(52) U.S. Cl. ..... 33/288; 33/600
(58) Field of Search ..... 33/286, 288, 533, 33/600, 645; 72/705

(56) References Cited

U.S. PATENT DOCUMENTS 2,799,190 A * 7/1957 Awot ..... 72/705
4,171,631 A * 10/1979 Butts ..... 72/705
4,291,467 A * 9/1981 Shultz, Jr. ..... 33/600
4,942,666 A * 7/1990 Wickmann et al. ..... 33/288
4,958,439 A * 9/1990 Dehn ..... 33/645
5,058,286 A * 10/1991 Chisum ..... 33/288
5,182,864 A * 2/1993 Yamashita ..... 33/288
5,247,750 A * 9/1993 Ito et al. ..... 33/533
6,216,524 B1 * 4/2001 Weschler ..... 72/705

* cited by examiner

*Primary Examiner*—G. Bradley Bennett
(74) *Attorney, Agent, or Firm*—Gottlieb, Rackman & Reisman, P.C.

(57) ABSTRACT

A repair device for repairing body panels for motor vehicles and the like includes a thin filament with a hook at one end and a Y-shaped body at the other. The device is used by attaching the hook and the body to the respective portions of the body and then tensioning the filament in between to establish a straight line. A body filler then may be added to repair the panel as required using the straight line as a guide. The filament may be cut off and left in the filler for reinforcement.

10 Claims, 2 Drawing Sheets

TOOL FOR VEHICULAR BODY PANEL REPAIR

BACKGROUND OF THE INVENTION

A. Field of Invention

This invention relates to the art of vehicular body repair, specifically to a guide useful in the repair process and reinforcement of damaged panels.

B. Description of the Prior Art

The most proficient and most commonly practiced technique of repairing body panels on a motor vehicle is implemented by using a device or tool to provide uniform straightness and accuracy of the vehicular body panels. The tool used is normally a straight-edged object which is placed up against the vehicle's body, thereby guiding the repair person in obtaining straightness and quality throughout the repair. An example would be a long ruler or a two by four inch wood building stud, the length varying, depending on the size of the repair.

The major disadvantages of using such an object is that it is time-consuming and inefficient in its operation. Moreover, the use of a straight edge is ultimately successful only if the repair person relies on his skill, experience and judgement in reforming the damaged area to meet the proper profiles in matching the surrounding undamaged area of the vehicle. Moreover, the straight edge is difficult to use because it is not self-affixed and it is not a constant visual or physical guide, and therefore does provide an immediate indicator in the process of adding or removing excess filler material. Furthermore, use of a straight edge causes wasted time, energy and material, because any slight irregular bend or curve in the straight edge will cause inaccurate straightness in the repair.

Improper placement or inconsistent placements of the straight edge up against the body panel(s) will cause improper or inconsistent readings throughout the job, thereby greatly reducing work efficiency and overall quality.

A further disadvantage of the straight edge is that it requires the use of a pencil or other marking instrument that is used to indicate high or low areas on a panel being repaired. When followed by the filling, filing and sanding stages, these high and or low indication marks must be removed or covered over, forcing the repair person to repeatedly replace and carefully reposition the straight edge against the panel to re-check and re-mark the areas repeated times during the repair process.

A further disadvantage of a straight edge is that, when attempting to repair a sharp longitudinal body line or tight indentation in the automotive body panel, the bulk of a straight edge itself may not allow it to fit within the contour of such a body curvature.

Finally, after use, the straight edge is removed so that it does not provide any additional strength to the repaired panel. The straight edge is large and bulky making it difficult for one person to use it effectively. The length of a straight edge is not adjustable, therefore one particular straight edge cannot be used for all jobs.

OBJECTIVES AND SUMMARY OF THE INVENTION

An important objective is to provide a new tool for repairing vehicular body panels which is easier to use than the prior art straight edge.

A further objective is to provide a tool which is relatively easy, compact and expensive to make.

Yet another objective is to provide a tool which is easy to use and hence requires minium training.

A further objective is to provide a tool which includes a disposable elongated filament left in the panel to provide reinforcement. Other objectives and advantages of the invention shall become apparent from the following description.

Briefly a tool for vehicular body panel repair comprises a filament having a first and a second end; mounting means for mounting said first end to a panel; and tensioning means attached to said second end for tensioning said filament after said filament has been attached on said panel to establish a straight reference line.

This arrangement provides several important advantages as descried below.

The tool adds strength and support to the repaired body by leaving a filament which may be made of a steel wire embedded in the filler material in the same way that steel reinforcement rods reinforce cement. This added reinforced strength to the filler material is most important and needed at the vulnerable edge of a body line contour. This outside comer is by far the area most subjected to potential damage during impacts, causing the filler to crack and even separate and fall off from the underlying substrate.

The wire acts as a support or net in retaining the paste-like body filler from sagging off of a side panel while in the filler application stage. The constant visual and physical guidance this tool provides assists the novice as well as the experienced professional in achieving increased speed, accuracy, and overall quality in performing body repair.

This tool can be used to repair one or more body panels at a time by simply adjusting the length of its filament from a few inches to the entire length of the vehicle, if necessary. This tool will help in the alignment and adjustment of panels as well as the precise reforming and rebuilding of individual or connecting panels.

The tool can be used in accurately guiding the alignment and installation of a pin striping tape and side body moldings. The tool can be used on small or large repairs because of its full adjustability.

The tool being accurate and precise gives a true reading every time it is used. This tool can be used as a guide in auto body repair, fiberglass boat repair, or as a guide in the construction and repair of composite aircraft bodies.

The tool attaches and detaches quickly and easily to nearly every panel on most vehicles. It is compact, yet strong and durable enough to withstand most abuse of hammering, filing, sanding, and the other stages of panel repair.

The tool can be used to easily repair a flat surface, gentle curvature or sharp body line contour in a panel without any deviation or uncertainty. This tool eliminates most of the skill needed by the repair person when reshaping and sculpturing intricate body contours and large areas to be repaired. This is accomplished by pulling the concave area of the dent up to the proximity of the taut filament(s). Once the metal is pulled up to the filament(s), the metal is prepared for the filling stage. Body filler is now applied over the prepared metal and the filament(s) in a motion running parallel with the filament(s). These taut filaments are located in the exact position that the pre-damaged panel was in. Now, it is simply needed to fill only the remaining concave irregularities of the dented surface. This is accomplished by filling to just over the level of the filament's true and straight position. As the body filler is being applied, the filament(s) add support as they help keep the filler in place preventing it from sagging. This allows for a heavier filling application thereby greatly reducing the overall time of the repair by reducing the total number of repeated applications.

While the filler is hardening, a standard body file is used to file any remaining high areas of body filler that covers over the level of the filament(s) up to the point of visually sighting the embedded filaments(s).

After the final application of body filler has been filed, the area of hardened filler can now be sanded by hand or by using a power sander, depending on the size of the repair. Here the filament(s) prevent possible over- or undersanding. Sanding is then completed when the full length of filament(s) are just barely exposed in the surface of the filler, leaving uniformity and flatness throughout the repaired surface.

The filament(s) can now be removed by simply loosening the thumb screw thereby relieving the tension that keeps the filament taut thereby holding the tool tightly onto the panel. The filament(s) can be pulled out of the surface of the filler.

The repair is finalized by a brief surface sanding to remove the faint impression left by the thin filament(s) in the filler. One or more filaments could be left embedded in the filler. This would reinforce high risk areas from future damage. An example being the vulnerable edge of a curvature.

DETAILED DESCRIPTION OF THE INVENTION

Figures 1, 2:
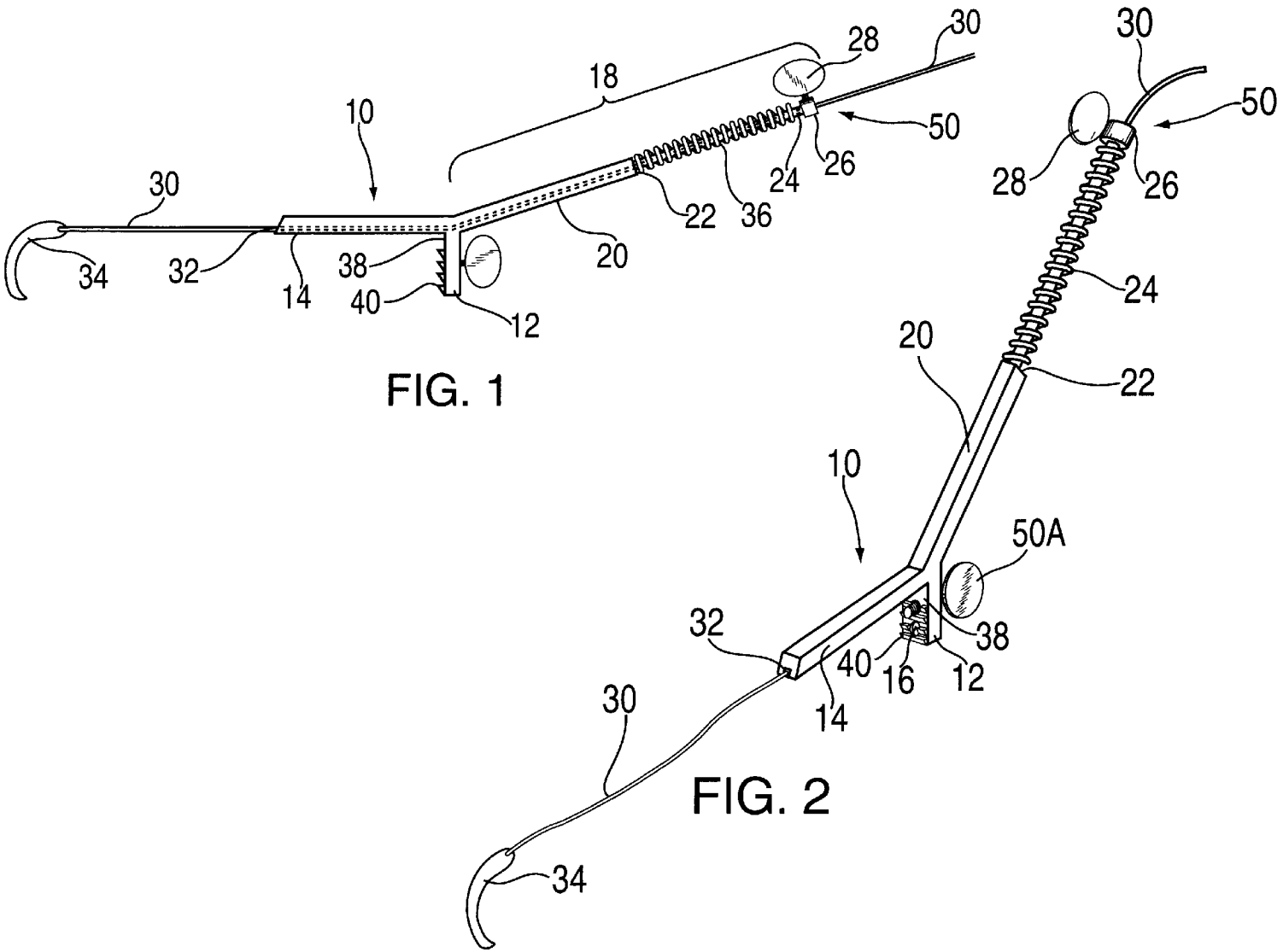
FIG. 1 shows an orthogonal view of a device constructed in accordance with this invention.
FIG. 2 is a side view of the device of FIG. 1.

Referring now to the figures, a tool constructed in accordance with this invention includes a generally T-shaped body 10 having a body shank 12, and a wire shank 14. Body shank 12 has one or more through holes as at 16 which may be internally threaded. Shanks 12 and 14 are approximately perpendicular to each other. Attached to and extending away from the corner formed by the shanks 12, 14 is a tensioning member 18. Tensioning member 18 is formed of an outer tube 20 terminating in a shoulder 22, and an inner tube 24 telescoping into outer tube 20 term. Inner tube 24 terminates in a collar 26 having a set screw 28. A filament 30 passes through the inner tube 24, outer tube 20 and through a hole (not shown) to the undersurface of shank 14. Preferably the filament 30 is disposed under shank 14 in a grove 32. The distal end of the filament 30 is mounted on a hook 34. A coil spring 36 is mounted on the inner tube between shoulder 22 and collar 26 thereby biasing collar 26 away from the shoulder 22. Preferably an inner surface 38 of shank 12 is serrated to form teeth 40 thereon said teeth being angled so that they point toward the underside surface of shank 14.

Preferably, the body 10 is metallic although it could be made of plastic materials as well. For example, shank 12 may be made of steel and can be welded together. Tubes 20, 24 may be made of brass with tube 20 being brazed to the shanks. Filament 30 may be made of high quality steel such as Monel.

Figure 3:
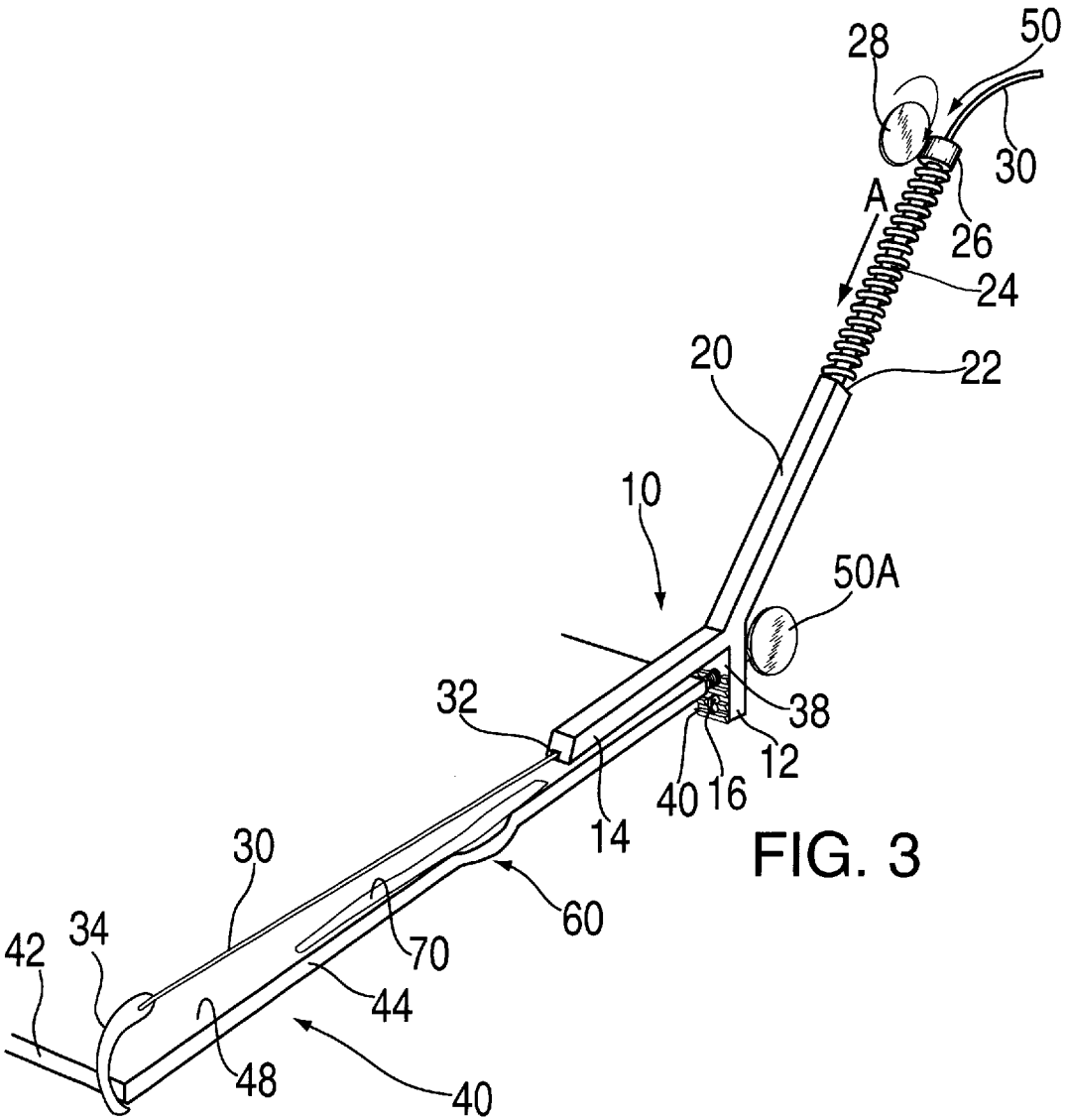
FIG. 3 is an orthogonal view of the device of FIGS. 1 and 2 showing how the devices is attached to a panel;l

The tool is used to repair a damaged panel 40 as follows (FIG. 3). Hook 34 is attached to an edge 42. The body 10 is then mounted on the opposing edge 44 with shank 14 being disposed in parallel to the outer surface 48 of panel 40 and shank 12 engaging the edge 44 as shown. Filament 30 extends from the hook 34 across surfaces 48 to body 10. The filament 30 is tensioned by hand by pulling on the end 50, and collar 26 is pushed toward shoulder 22 as indicated by arrow A, thereby compressing spring 36. Thumb screw 28 is tightened to thereby secure the collar 26 to the filament 30. In this manner, the biasing of spring 24 causes a tension in filament 30 and maintains the tool in place. One or more units or tools can be used to span across and beyond the damaged area 60 of panel 40. The repair person can now start the standard repair process, being guided and assisted by the proper physical reference provided by using the filament 30 as a reference. This may be accomplished by pulling the concave area of the dent up to the proximity of the taut filament 30. Once the metal of panel 40 is pulled up to the filament(s), it is prepared for the filling stage. Body filler is now applied over the prepared metal and the filament(s) in a motion running parallel with the filament(s) as at 70. The taut filaments are located in the exact position of the panel surface prior to the damage. Now, it is simply needed to fill only the remaining concave irregularities of the dented surface. This is accomplished by filling to the level of the filaments true and straight position. As the body filler is being applied, the filament(s) added support help keep the filler in place preventing it from sagging. This allows a heavier filling application, greatly reducing the overall time of the repair by reducing the total number of repeated applications. The hook 34 and body 10 are cut off and removed, leaving the filament 30 in place.

While the filler is hardening, a standard body file or sander is used to file any remaining high areas of body filler that covers over the level of the filament(s). During sanding, the filament(s) which are now embedded in the hardening body filler act as a physical guide preventing the file from overcutting the hardened filler material. This is accomplished by protecting the filler or sandpaper from the sharp, heavy cutting teeth of the file which rides atop the embedded filaments(s).

The tool is a completely different and unique approach to auto body repair which eliminates most creative abilities and accumulated skills needed in the art of vehicle damage repair. This is accomplished by providing the user with a mechanical means of finding the misaligned or damaged panel's original position contour by simply sighting the filament's true and affixed presence through out the many stages of the repair.

The tool also simplifies the art of panel repair to a point where most previously determined irreparable panels may now be considered repairable because of the times saving factor and the reduction of skill level needed by the repair person using this tool.

This tool can be used as a guide in auto body repair as well as in fiberglass boat repair, and as a guide in the construction and repair of composite aircraft.

The tool is compact, strong, reusable, and is durable enough to withstand the abuse from contact with power tools and files during the repair process. It also adds support and strength to the damaged repair area by providing the user with the option of leaving the filament portion of the tool permanently embedded in the filler material, thus creating added strength to the repair. It can be adjusted to repair an area just a few inches in length or the entire length of the vehicle itself. It provides the visual and physically reinforced guidance to make the repair to a sharp body line curvature as well as flat areas in a panel without deviation or uncertainty. It provides a means of quickly adjusting, attaching to nearly every area on a vehicle's body surface, sometimes being assisted with the use of one of the various attachments described in the attached drawings.

The above patent provides a highly reliable, extremely helpful yet economical tool that can be used by amateurs and professional alike. While my above description contains many specifics, these should not be construed as limitations on the scope of the invention but rather as exemplification of one preferred embodiment thereof.

For example, if necessary, shank 12 may be temporarily attached to the side wall of a panel by using a thumb screw 50A or other similar means through one of holes 16. In other instances, it may be necessary to pass the filament around an angled portion or a corner of a panel. In these instances, a small diameter tube (not shown) may be disposed on the filament before installation and then the tube may be positioned at the corner to allow the filament to move longitudinally without rubbing against the panel. In yet other instances, for example for extremely long panels, the filament may be secured temporarily to the panel after the filament is stretched to insure that the filament does not sag. This may be accomplished by tacking the filament to the panel or by using a pair of vacuum cup mounted posts on either side of the filament, with a cable extending between the posts and a support rod extending normally from the cable to the filament to maintain the filament in a preselected position.

Many other variations are possible. For example, this invention can utilize any type of this invention in situations where the contained optional embodiments cannot provide proper positioning of the filament. A riverting means can be used in facilitating the proper positioning of the filament in the rare instance where the embodiments cannot be attached. However, riveting means is less desirable in that it further damages a panel by leaving perforations in the panel.

Another application in which the invention is used is in chassis and frame straightening by pre-determining the proper pulling distances of a damaged or bent frame member by restoring it to its original length.

Figure 4:
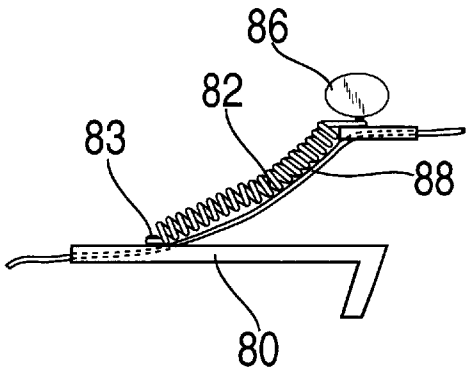
FIG. 4 shows an alternate embodiment of the invention.

In the embodiment of the invention shown in FIG. 4, a tool is shown with an L-shaped body 80. Attached to the body 80 is a curved spring 82 which may be about 1"×0.02" and about 2–3 mm wide. One end of spring 82 is attached to body 80 by a rivet 83, a screw or other well known means. The other end supports a member 84 holding a thumb screw 86. Filament 88 extends to the thumb screw 86 along the spring 82 and is tensioned by the spring 82. This embodiment is used in the same manner as the embodiment of FIGS. 1–3

The scope of the invention should be determined not by the embodiments illustrated, but by the appended claims and their legal equivalent.

What is claimed:

1. A vehicular body contour repair device comprising:

a filament having a first end and a second end;

a mounting member for mounting said first end to a panel; and a tensioning member attached to said second end for tensioning said filament after said filament has been attached on said panel to establish a straight references line.

2. The device of claim 1 wherein said mounting member includes a hook mounted at said first end.

3. The device of claim 2 wherein said mounting member includes a body for mounting said filament on a side of the panel.

4. The device of claim 3 wherein said tensioning member is attached to said body.

5. The device of claim 4 wherein said tensioning member includes a tubular member attached to said body with said filament second end passing through said tubular member, a collar secured to said second end, and resilient member for urging said collar away form said tubular member.

6. The device of claim 5 wherein said resilient member is a coil spring.

7. A method of repairing a body panel having a first and second body portion and a panel surface extending therebetween, said method comprising the steps of:

attaching one end of a filament to said first body portion;

attaching an intermediate portion of said filament to said second body portion; and tensioning said filament between said first and second body portions to establish a straight line.

8. The method of claim 7 further comprising adding a body filler material to said panel along said filament.

9. The method of claim 8 wherein said filament is imbedded in said body filler material.

10. The method of claim 9 further comprising the step of cutting the ends of said filament and leaving said filament in said body filler material.

* * * * *